US011672343B2

(12) United States Patent
DuFresne

(10) Patent No.: US 11,672,343 B2
(45) Date of Patent: Jun. 13, 2023

(54) 4-STAR BASE FOR A CHAIR

(71) Applicant: Anthro Form, LLC, Waukesha, WI (US)

(72) Inventor: Steven DuFresne, Hartland, WI (US)

(73) Assignee: Anthro Form, LLC, Waukesha, WI (US)

( * ) Notice: Subject to any disclaimer, the term of this patent is extended or adjusted under 35 U.S.C. 154(b) by 0 days.

(21) Appl. No.: 17/848,667

(22) Filed: Jun. 24, 2022

(65) Prior Publication Data

US 2023/0018551 A1 Jan. 19, 2023

Related U.S. Application Data

(60) Provisional application No. 63/221,653, filed on Jul. 14, 2021.

(51) Int. Cl.
*A47C 3/20* (2006.01)
*A47C 7/00* (2006.01)

(52) U.S. Cl.
CPC ..... *A47C 7/006* (2013.01); *A47C 3/20* (2013.01); *A47C 7/004* (2013.01)

(58) Field of Classification Search
CPC ..... A47C 7/006; A47C 7/004; A47C 3/20; A47C 9/02
USPC ..... 297/239, 461; D6/708.23, 708.24; 248/188.7
See application file for complete search history.

(56) References Cited

U.S. PATENT DOCUMENTS 4,238,097 A 12/1980 Boeddeker
D297,690 S * 9/1988 Opsvik ..... D6/708.24 X
D412,416 S * 8/1999 Ritch ..... D6/708.23
6,030,037 A * 2/2000 Ritch ..... A47C 7/004 297/331
6,142,566 A * 11/2000 Ritch ..... A47C 3/045 297/331
6,286,901 B1 * 9/2001 Ritch ..... A47C 3/04 297/239 X
6,427,804 B1 8/2002 Lazarus
D549,015 S * 8/2007 Petrick ..... D6/708.24
7,325,873 B2 * 2/2008 Stewart ..... A47C 3/04 297/239
7,380,880 B2 6/2008 Molen
(Continued)

FOREIGN PATENT DOCUMENTS

CN 204273837 U 4/2015
CN 107969838 A 5/2018
(Continued)

OTHER PUBLICATIONS

International Search Report and Written Opinion of the International Search Authority dated Dec. 23, 2022, received in connection with International Application No. PCT/US2022/036934 filed Jul. 13, 2022.

*Primary Examiner* — Rodney B White
(74) *Attorney, Agent, or Firm* — Boardman & Clark LLP

(57) ABSTRACT

A base for a chair is described. The example base for the chair includes a central support coupled to a seat pan of the chair, a first pair of legs extending radially from the central support, and a second pair of legs extending radially from the central support. The first pair of legs extend in a direction opposite the second pair of legs. A first angle between the first pair of legs is larger than a second angle between the second pair of legs.

22 Claims, 7 Drawing Sheets

(56) References Cited

U.S. PATENT DOCUMENTS

| | | | | | |
|---|---|---|---|---|---|
| D615,324 | S | * | 5/2010 | Yamamoto | D6/696.1 |
| D665,191 | S | * | 8/2012 | Yamamoto | D6/656.15 |
| D669,282 | S | * | 10/2012 | Yamamoto | D6/691.6 |
| D693,152 | S | * | 11/2013 | Yamamoto | D6/656.15 |
| 8,616,651 | B2 | | 12/2013 | Matthews | |
| D702,840 | S | * | 4/2014 | Blomquist | D24/164 |
| D722,696 | S | * | 2/2015 | Blomquist | D24/164 |
| 9,510,682 | B2 | * | 12/2016 | Hasegawa | A47C 3/18 |
| 9,986,837 | B2 | | 6/2018 | Czumaj-Bront | |
| D827,139 | S | * | 8/2018 | Henderson | D24/160 |
| D830,747 | S | * | 10/2018 | Harvey | D6/707.22 |
| 10,631,643 | B2 | | 4/2020 | Lin et al. | |
| D888,966 | S | * | 6/2020 | Robert | D24/185 |
| D921,408 | S | * | 6/2021 | Bergsma | D6/708.17 |
| D955,147 | S | * | 6/2022 | Hirshburg | D6/708.23 |
| 2005/0151037 | A1 | | 7/2005 | Oxley | |
| 2007/0216131 | A1 | | 9/2007 | Potappel | |
| 2009/0195043 | A1 | | 8/2009 | Oda et al. | |

FOREIGN PATENT DOCUMENTS

| | | | | | |
|---|---|---|---|---|---|
| CN | 108420215 | A | * | 8/2018 | A47C 3/18 |
| CN | 108420215 | A | | 8/2018 | |
| CN | 109998321 | A | * | 7/2019 | A47C 7/002 |
| CN | 109998321 | A | | 7/2019 | |
| JP | 2003325264 | A | | 11/2003 | |

* cited by examiner

4-STAR BASE FOR A CHAIR

CROSS-REFERENCE TO RELATED APPLICATIONS

This application claims the benefit of U.S. Provisional Patent Application No. 63/221,653 filed Jul. 14, 2021, entitled "4-STAR BASE FOR A CHAIR," the entire content of which is hereby incorporated herein by reference.

BACKGROUND

A large portion of the population sits in an office chair for an extended period of time every day. Most office chairs have a typical 5-legged "star" base that rotates relative to the seat of the chair. However, due to the position and spacing of the legs on these 5-legged bases, at least one of the chair legs is always randomly spinning to a position such that the user may inadvertently kick the leg or the leg may run into the user's foot and cause pain or cause damage to the user's shoes. Continuously or periodically kicking the casters can lead to injury to the user's feet and/or cause damage to the user's shoes.

SUMMARY

Described herein is a base for a chair that solves the problems of the chair legs being in the way of the user's feet. The example base described herein includes an open area for a user to position their feet when sitting in the chair. A rotationally fixed base used with some example constructions also prevents the legs of the chair from rotating to a position that is not convenient for the user.

An example base for a chair described herein includes a support coupled to a seat pan of the chair. The chair includes a front pair of legs extending radially from the support, and a back pair of legs extending radially from the support. The back pair of legs extend in a direction opposite the front pair of legs. A first angle between the front pair of legs is larger than a second angle between the back pair of legs.

Another example base for a chair includes a central support, a first leg and a second leg extending from the central support. Each of the first leg and the second leg extend toward opposing front corners of a seat. A third leg and a fourth leg extend from the central support. Each of the third leg and the fourth leg extend toward opposing rear corners of the seat. A first angle between the first leg and the second leg is larger than a second angle between the third leg and the fourth leg. Casters are coupled to ends of each of the legs.

Another example chair includes a non-rotating support. Legs extend radially from the non-rotating support. A pair of the legs define an area under a front of the chair in which a user may position their feet. An angle between the pair of the legs is at least 90 degrees.

BRIEF DESCRIPTION OF THE DRAWINGS

Various examples of embodiments of the systems, devices, and methods according to this invention will be described in detail, with reference to the following figures.

It should be understood that the drawings are not necessarily to scale. In certain instances, details that are not necessary to the understanding of the invention or render other details difficult to perceive may have been omitted. It should be understood, of course, that the invention is not necessarily limited to the particular embodiments illustrated herein.

DETAILED DESCRIPTION OF THE DRAWINGS

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Figure 1:
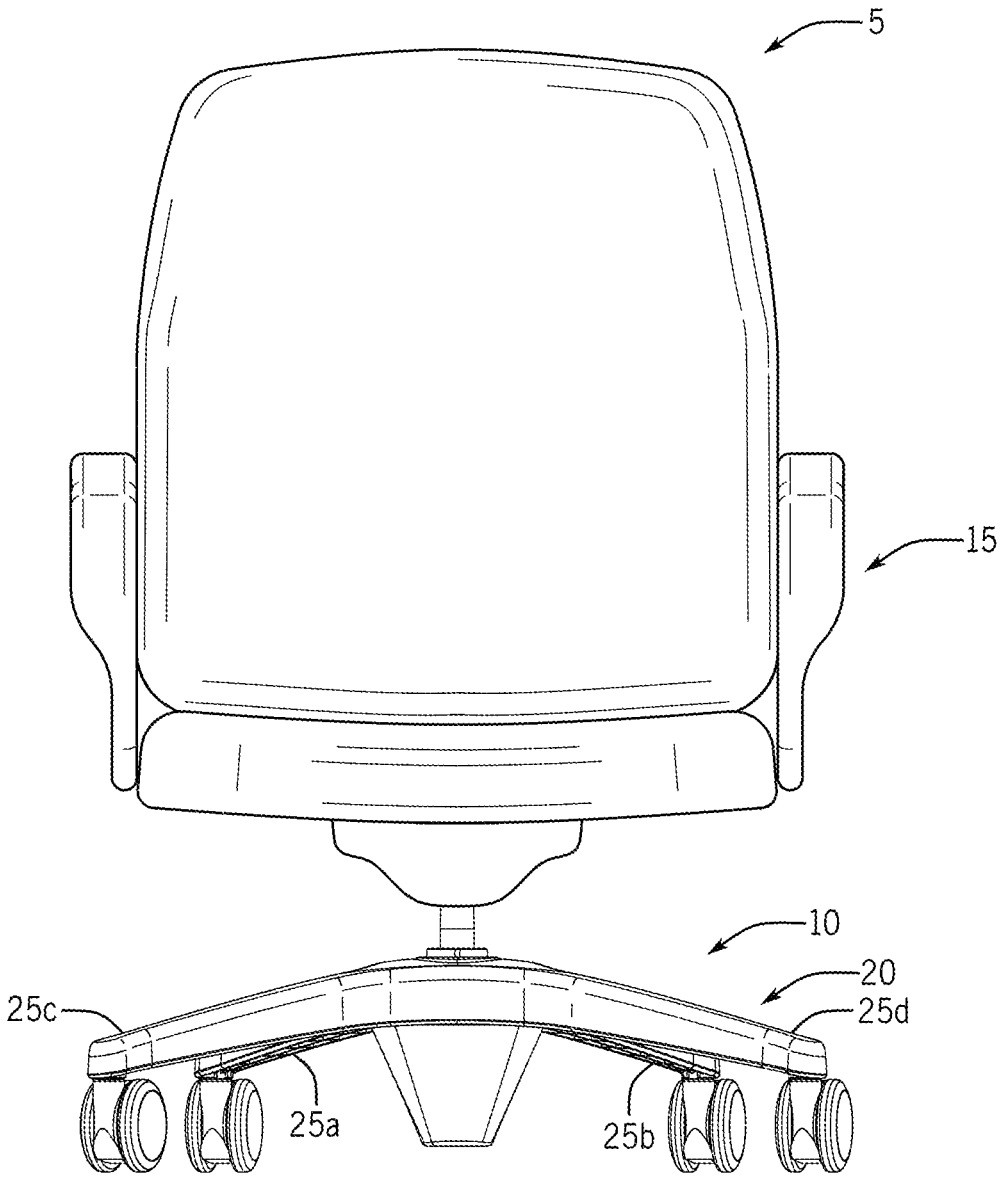
FIG. 1 depicts an example chair with which an example base described herein may be used.
Figure 2:
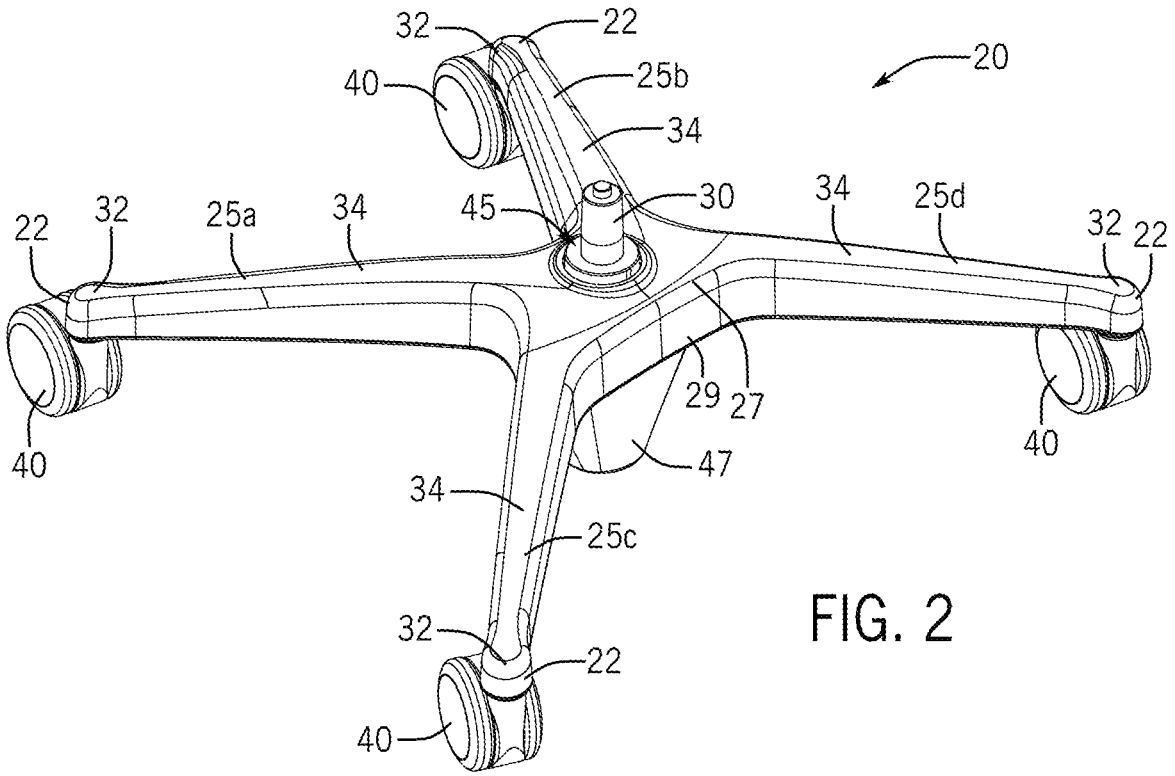
FIG. 2 is a more detailed perspective view of the base depicted in FIG. 1.
Figure 3:
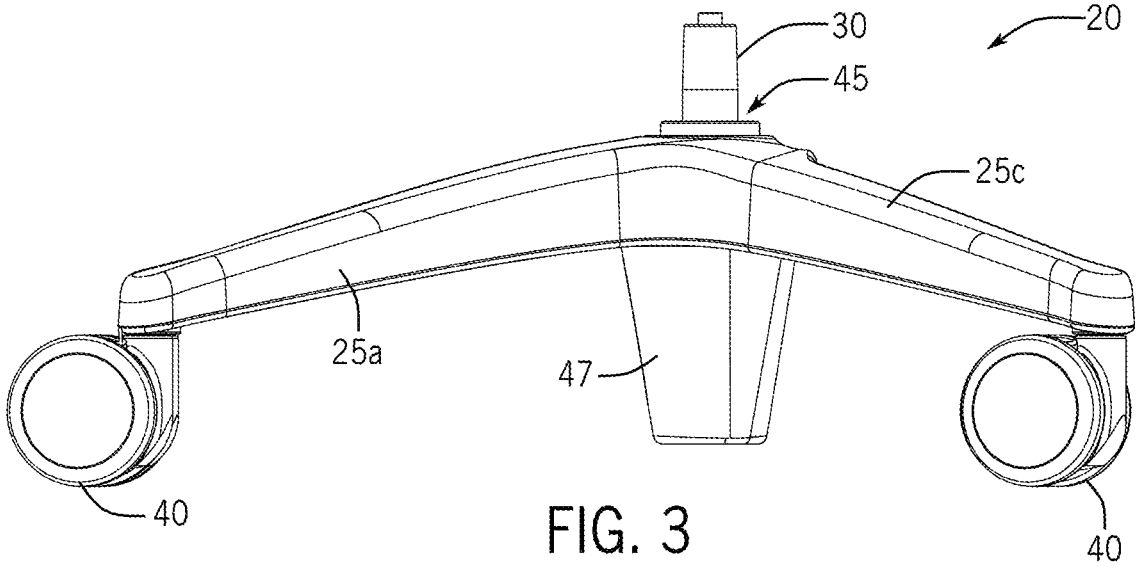
FIG. 3 is a side view of the base depicted in FIG. 2.
Figure 4:
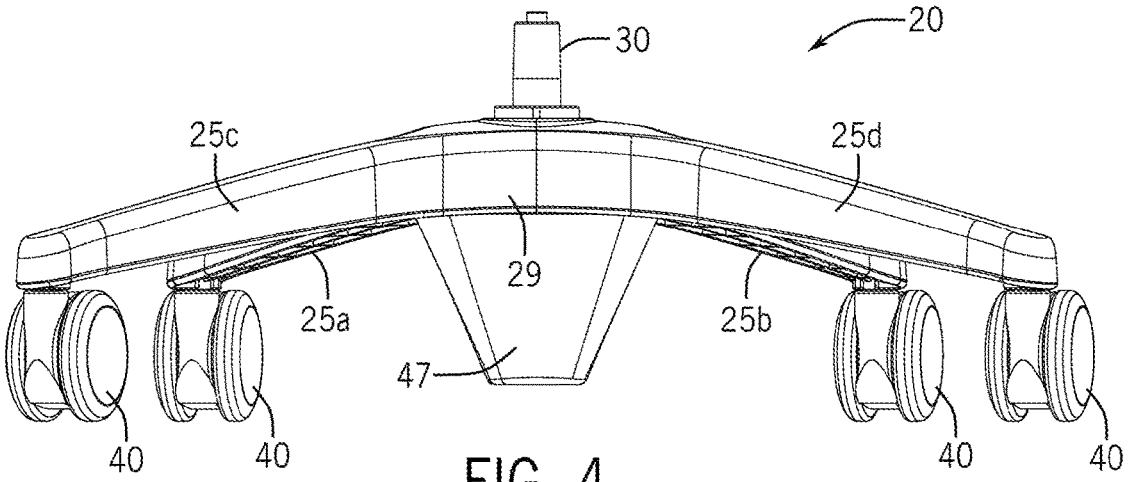
FIG. 4 is a front view of the base depicted in FIG. 2.
Figure 5:
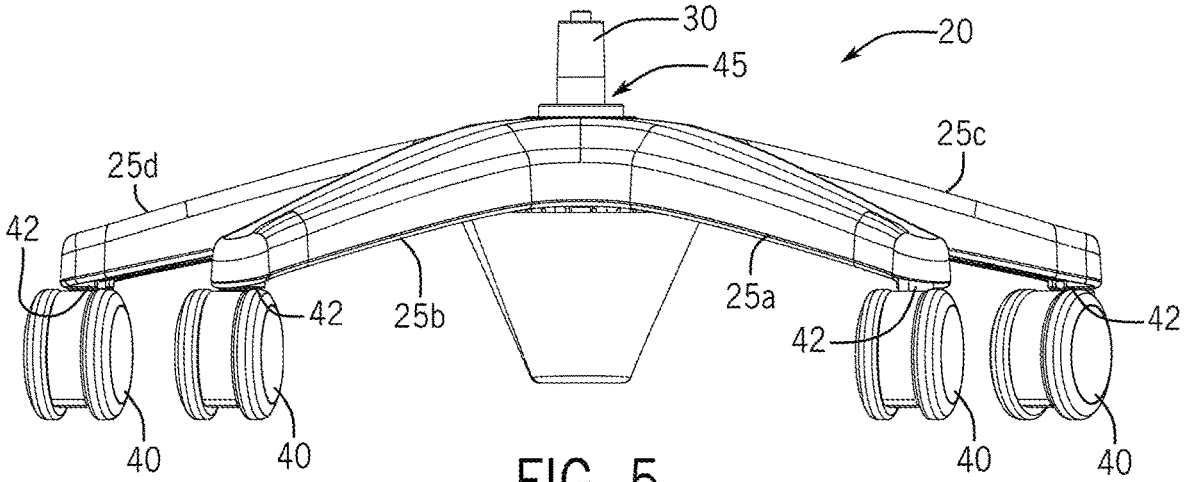
FIG. 5 is a back view of the base depicted in FIG. 2.
Figure 6A:
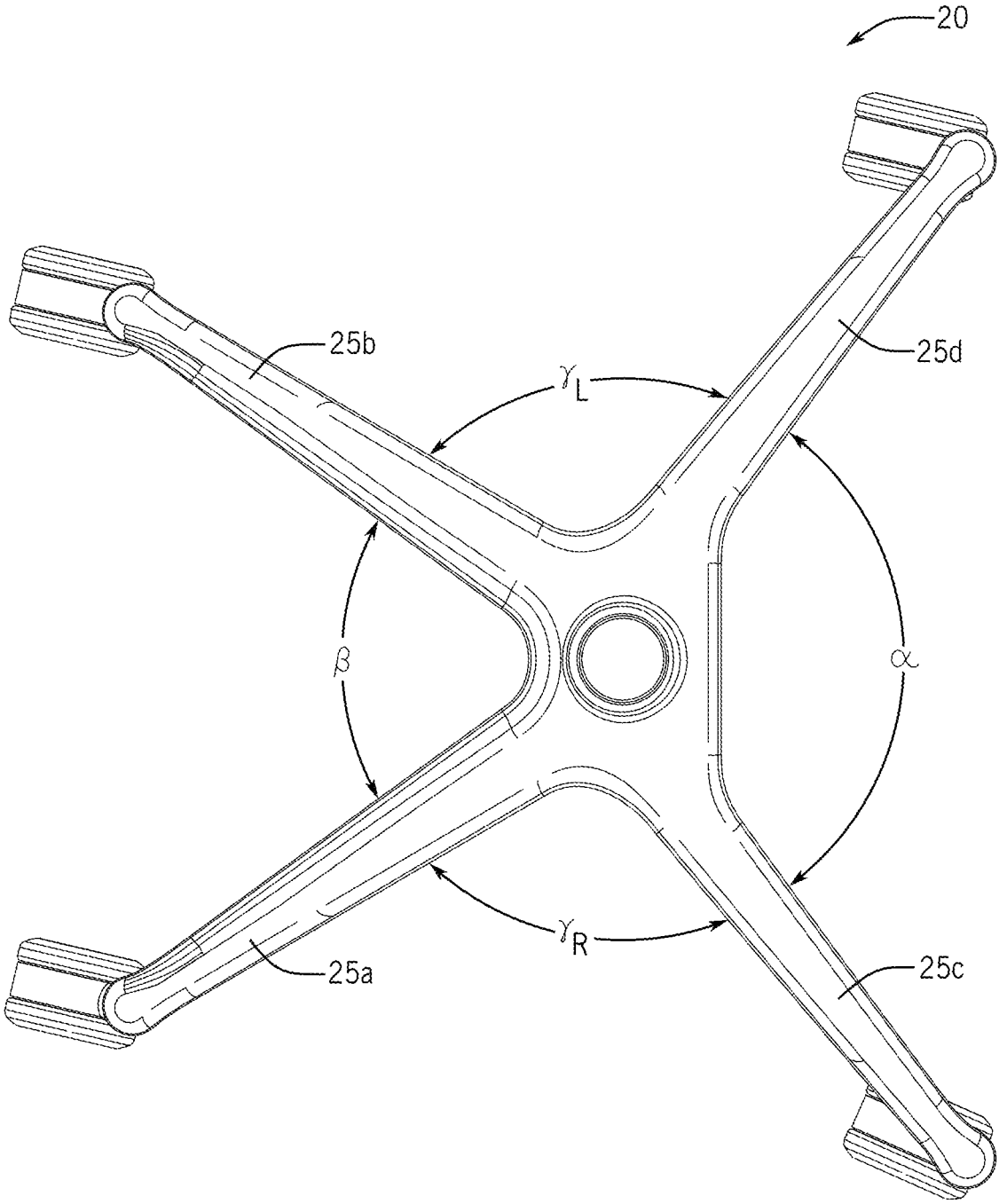
FIGS. 6A and 6B are a top view of the base depicted in FIG. 2.
Figure 6B:
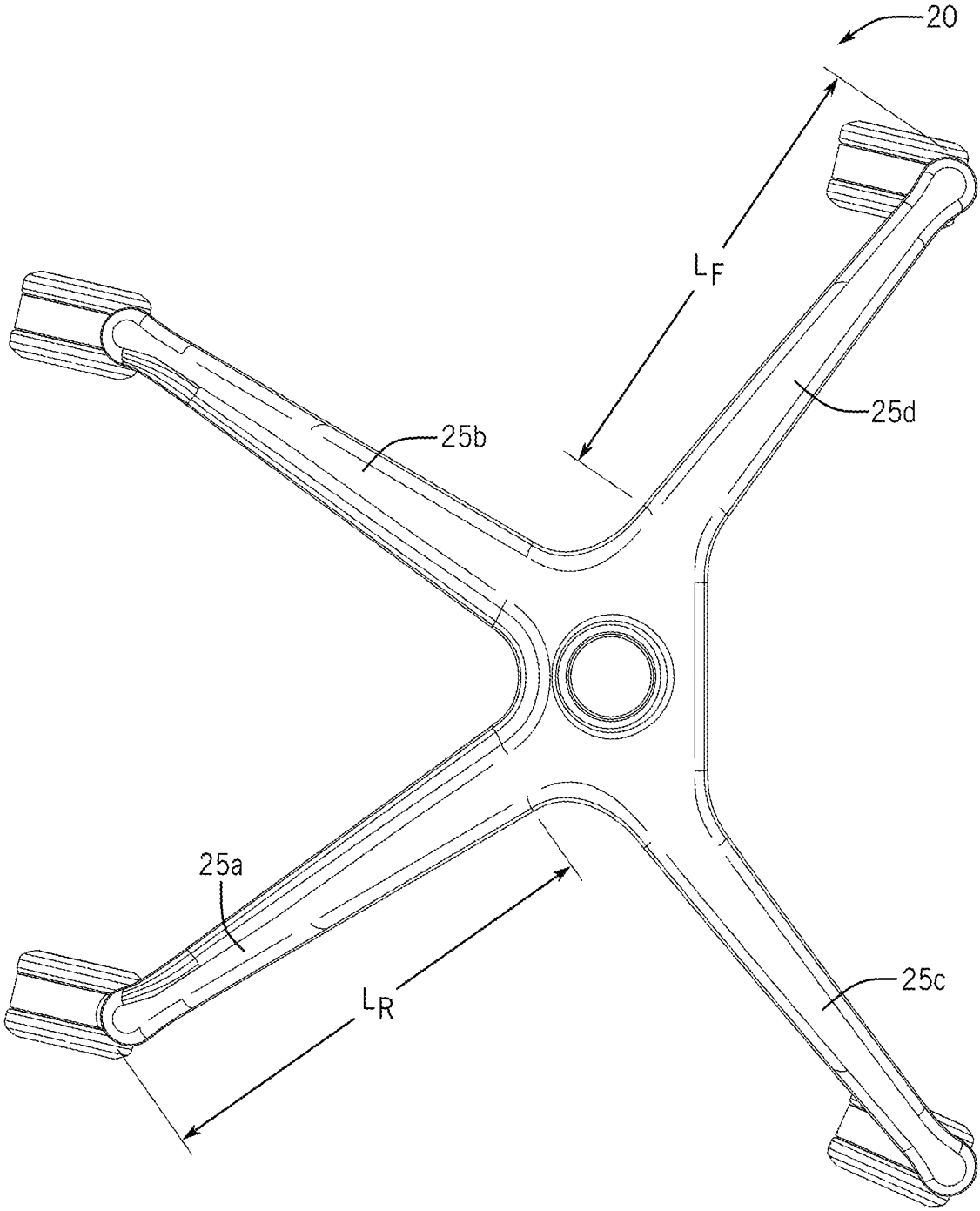

FIG. 1 depicts an example chair 5 with which an example base 10 described herein may be used. The example chair 5 is an office chair (e.g., a task chair, an executive chair, a desk chair, other seating device) including the base 10 and a seat 15. However, the example base 10 described herein may be used with other types of seating, including stools.

The example base 10, as described in greater detail below, includes a leg assembly 20 including four legs 25*a*, 25*b*, 25*c*, 25*d*, and a height adjustable piston 30. The example piston 30 is coupled to the seat pan of the chair 5. In some examples, the piston 30 is coupled to the seat 15 in a non-rotatable configuration. That is, the seat 15 (and thus the chair) does not rotate relative to the piston 30. Alternatively, the piston 30 may be rotatably coupled to the seat 15 of the chair 5. Additionally, the leg assembly 20 may be non-rotatably coupled to the piston 30 such that the leg assembly 20 does not rotate relative to the piston 30. In other examples, the leg assembly 20 is rotatably coupled to the piston 30. In the illustrated example, a cap 47 may be added to the base 10 and cover the piston 30. In some examples, this cap 47 is snapped onto the leg assembly 20. Alternatively, the cap 47 may be attached to the leg assembly 20 using other mechanical fasteners (e.g., screws). Alternatively, the cap 47 may be mounted directly to the piston 30. In some examples, the cap 47 is enclosed and is operative to collect oil or hydraulic fluid from a failed piston 30. Alternatively, the cap 47 is decorative.

FIGS. 2-6B depict additional views of the example base 10 for the chair 5, in particular the leg assembly 20 of the illustrated base 10. The example leg assembly 20 is made of plastic. In some constructions, the leg assembly 20 is injection molded plastic. In alternative constructions, the leg assembly 20 may be formed using a different method. Alternatively, the leg assembly 20 may be made of a different material, such as metal. In some examples, the leg assembly 20 may include five or more legs. A caster 40 or glide may be attached to an end 22 of each leg 25*a*, 25*b*, 25*c*, 25*d*. The example casters 40 or glides are coupled to the ends 22 of each leg with a post 42 inserted into an aperture at the end 22 of each leg. The example casters 40 may be freely rotating around the post 42. Example glides may simply consist of a smooth piece (e.g., a plastic piece) that enables the chair 5 to easily glide on flooring (e.g., carpet).

The example leg assembly 20 includes four legs 25*a*, 25*b*, 25*c*, 25*d* extending in a substantially or modified x-shape, which may also be referred to as a double-v shape. The legs 25*a*, 25*b*, 25*c*, 25*d* extend from an aperture 45 in the leg assembly 20 through which the piston 30 or a central support may be positioned. As used herein, central is not be equated with center but encompasses center and near the center. In the illustrated example, a connection piece 27 may be positioned between the front two legs 25*c*, 25*d* which may increase stability or strength of the structure that forms the legs 25*a*, 25*b*, 25*c*, 25*d*. The connection piece 27 may have a substantially flat front surface 29. The front surface 29 may be parallel to a front edge of a seat 15 of the chair 5.

Figure 8:
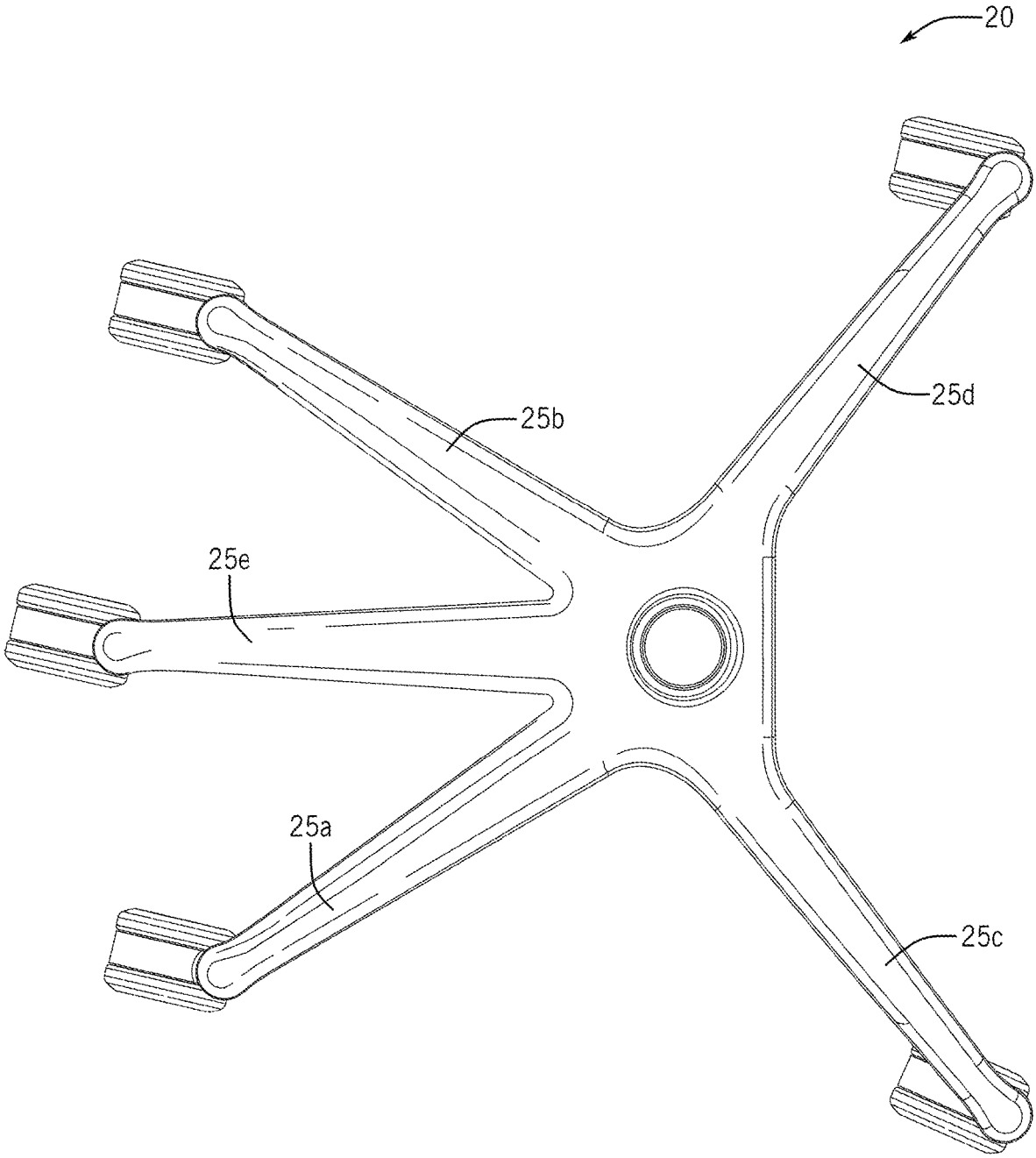
FIG. 8 is a top view of an alternative example base.

The back legs 25*a*, 25*b* may be mirrors of one another, thereby forming a first substantially v-shape. The back legs 25*a*, 25*b* extend away from a connection point adjacent the piston 30. The back legs 25*a*, 25*b* extend substantially toward (e.g., in a general direction of) respective back corners of the seat 15 of the chair 5. In some embodiments, the back legs 25*a*, 25*b* extend backward but do not extend past the edges (e.g., back corners) of the seat 15. In alternative embodiments including more than four legs, the front legs 25*c*, 25*d* may extend forward to form a substantially symmetrical shape as shown and described herein, while the remaining rear legs can extend in a different formation to support the seat. In one example construction, the outermost legs extend substantially toward respective back corners of the seat 15 of the chair 5, thereby defining an interior space for one or more remaining back legs. For example. FIG. 8 shows leg 25*e* disposed in the interior space. Other variations for the rear legs are possible.

In the illustrated construction, the back legs 25*a*, 25*b* have a tapered thickness from the connection point adjacent the piston 30 to the end 22 of the legs. The back legs 25*a*, 25*b* are also angled from a connection point adjacent the aperture 45 to a connection point for the casters 40. A width of the back legs 25*a*, 25*b* is also slightly tapered from the connection point adjacent the aperture 45 toward the connection point of the casters 40. Each end 22 of each of the back legs 25*a*, 25*b* has a cylindrical portion 32 that includes an aperture where the casters 40 are attached. The cylindrical portion 32 may be offset from a centerline of the respective leg 25*a*, 25*b*. In the illustrated construction, the cylindrical portion 32 is offset toward the inside (e.g., toward the opposing back leg 25*a*, 25*b*) of the chair 5. Alternatively, the cylindrical portion may be centered or offset toward the outside of the chair 5. A top surface 34 of each of the back legs 25*a*, 25*b* has a rounded end at the point where the casters 40 are attached. The illustrated leg assembly 20 is constructed to enable the connection of various types of existing casters 40 and/or glides so that the type of casters 40 can be customized.

The front legs 25*c*, 25*d* may also be mirrors of one another, thereby forming a second substantially v-shape. The front legs 25*c*, 25*d* angle away from a connection point adjacent to the piston 30. The front legs 25*c*, 25*d* extend substantially toward (e.g., in a general direction of) respective front corners of the seat 15 of the chair 5. In some embodiments, the front legs 25*c*, 25*d* extend forward and may also extend past the edges (e.g., front corners) of the seat 15. The front legs 25*c*, 25*d* of the example leg assembly 20 may be thinner than the back legs 25*a*, 25*b*. The front legs 25*c*, 25*d* have a width that tapers slightly from the connection point adjacent the aperture 45 toward the connection point of the casters 40. The illustrated front legs 25*c*, 25*d* have a tapered thickness, and are angled from the connection point adjacent the aperture toward the connection point for the caster 40, similarly to the illustrated back legs 25*a*, 25*b*. Each end 22 of each of the front legs has a cylindrical portion 32 that includes an aperture where the casters 40 are attached. The cylindrical portion 32 may be offset from a centerline of the respective leg 25*c*, 25*d*. In the illustrated construction, the cylindrical portion 32 is offset toward the inside (e.g., toward the opposing front leg 25*c*, 25*d*) of the chair 5. Alternatively, the cylindrical portion may be centered or offset toward the outside of the chair 5. A top surface 34 of each of the front legs 25*a*, 25*b* has a rounded end at the point where the casters 40 are attached. Similar to the back legs 25*a*, 25*b*, the caster connecting point enables the connection of various types of existing casters 40. As discussed above, the connection piece extends between the front legs 25*c*, 25*d*.

In the illustrated construction, an angle between the front two legs 25*c*, 25*d* (e.g., a front leg angle $\alpha$) is wider than an angle between the back two legs 25*a*, 25*b* (e.g., a back leg angle $\beta$). The front two legs 25*c*, 25*d* are also longer (i.e., the front legs have a length $L_F$ that is longer than a length $L_B$ of the back legs) and extend further past the front edge of the example chair 5 than the back legs 25*a*, 25*b* extend past the back edge of the chair 5. The longer length $L_F$ of the front legs 25*c*, 25*d* helps act as a counter-balance to reduce or eliminate the risk of tipping the chair 5 backwards. Additionally, the front legs 25*c*, 25*d* of the example construction are longer than legs of a typical 5-legged chair base. Alternatively, another construction may have two front legs 25*c*, 25*d* that are shorter than two back legs 25*a*, 25*b*. In such an example construction, the additional length $L_B$ of the back legs 25*a*, 25*b* may act as a support to prevent over-rotation or tipping of the chair 5. In the illustrated example, the front legs may have a length $L_B$ of approximately 348 mm and the back legs 25*a*, 25*b* may have a length $L_B$ of approximately 346 mm. However, in some alternative examples, the front legs 25*c*, 25*d* may be longer and the back legs 25*a*, 25*b* may be shorter. The lengths $L_F$, $L_B$ of the legs 25*a*-25*d* can be selected based in part on respective angles between the front legs 25*c*, 25*d* and between the back legs 25*a*, 25*b*. Additionally, the lengths $L_F$, $L_B$ of the legs 25*a*-25*d* were determined using the Business and Institutional Furniture Manufacturers Association's (BIFMA) rear stability test such that the length of the rear legs 25*a*, 25*b* was long enough to prevent tipping of the chair. For the drawing of FIG. 6*b*, the length $L_F$ and the length $L_B$ are shown with respect to the connection piece 27. In other embodiments, the length $L_F$ and the length $L_B$ can be with respect to the piston 30.

The front leg angle $\alpha$ may be greater than an angle between legs of a typical 5-legged base, which are conventionally symmetrical. In the illustrated example, the front leg angle $\alpha$ is greater than 90 degrees, and a center of the angle $\alpha$ is aligned with a center of the front edge of the chair 5. For example, the front leg angle $\alpha$ may be between 72 to 115 degrees, and is preferably between 100 and 115 degrees. The wide angle $\alpha$ between the front legs 25*c*, 25*d* allows for more leg room and foot room for the user. Additional leg room reduces or eliminates issues with a typical 5-legged base, such as the user hitting their feet and injuring their feet or scuffing their shoes on the casters and legs of the base.

The back leg angle β of the example leg assembly 20 may be less than the angle α between the front legs. In the illustrated construction, the back legs 25*a*, 25*b* may be positioned approximately 70 degrees apart. The back leg angle β may be between 60 and 90 degrees, and is preferably between 75 and 85 degrees. In an alternative construction including more than four legs, the back leg angle β may be less than 60 degrees.

In some examples, an angle between the left side legs (e.g., a left side leg angle $\gamma_L$ between the front left leg and the back left leg) is the same as (i.e., equal to) an angle between the right side legs (e.g., a right side leg angle $\gamma_R$ between the front right leg and the back right leg). In the illustrated construction, the left side angle $\gamma_L$ and right side angle $\gamma_R$ is approximately 90 degrees. The left and right side leg angles $\gamma_L$, $\gamma_R$ vary based on the front and back leg angles α, β.

Figure 7:
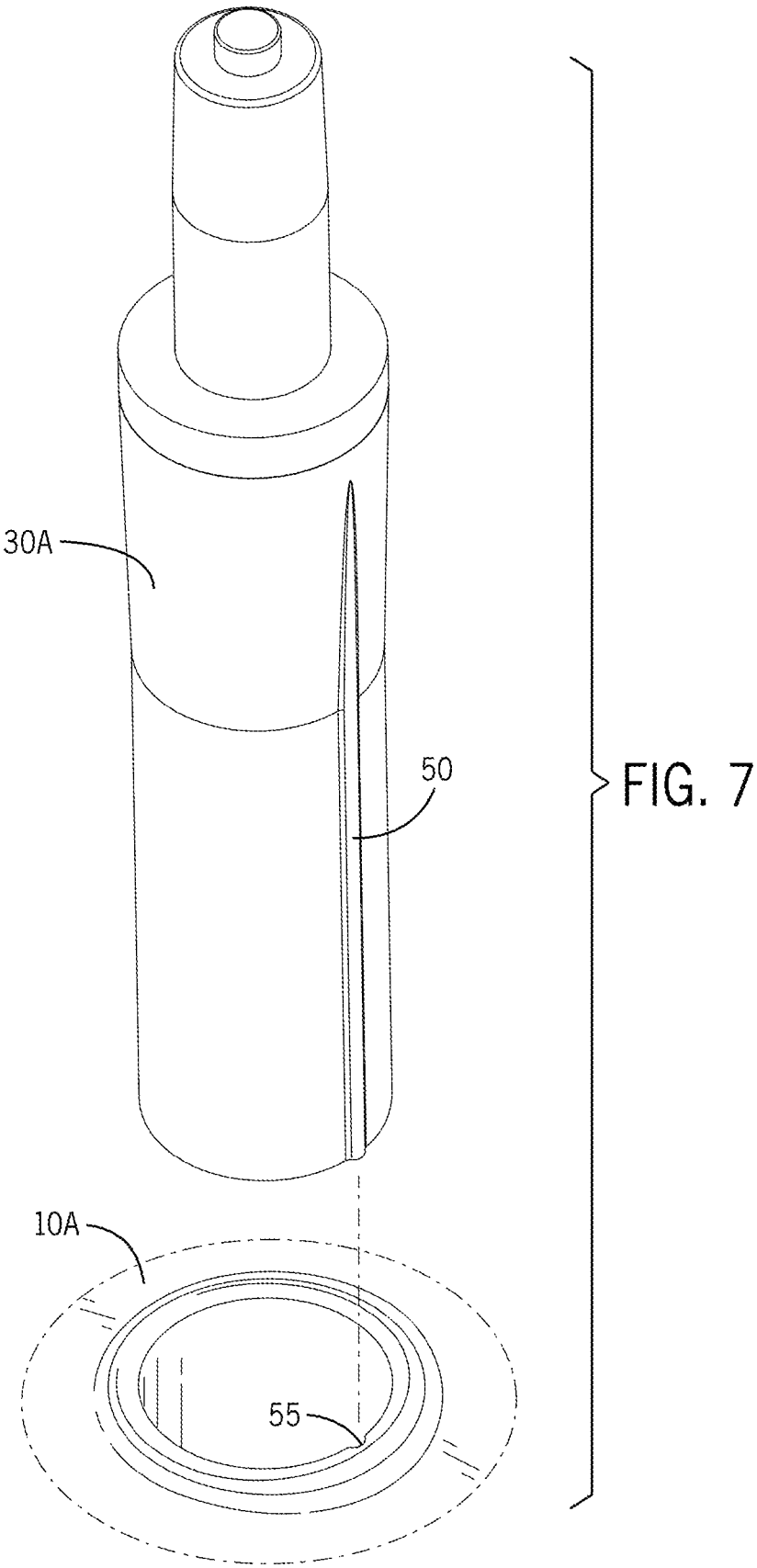
FIG. 7 is a partial exploded view of a keyed piston and aperture that may be used with the chair in FIG. 1.

The example leg assembly 20 may be fixed relative to the seat 15 of the chair 5. In some examples, the piston 30 is taper-locked or keyed to prevent rotation, as described in greater detail below. Other methods of fixing the leg assembly 20 relative to the seat 15 may be used instead. The base 10 is intended to not rotate out of position once assembled to prevent rotational misalignment of the legs 25*a-d*. Misalignment can happen most often while pushing the chair 5 into and/or under a desk or table and making contact between the front legs 25*c*, 25*d* and a leg or base of the desk or table or other furniture. The same can happen while seated in the chair 5 and rolling any direction coming in contact with a piece of furniture or a wall. Rotational misalignment can be reduced with a tight-fitting taper feature at the base 10 of the piston 30 that fits into the aperture 45 and an equally tight-fitting taper in the top portion of the piston 30 which fits into the mechanical device on an underside (e.g., an underside of the seat pan) of the example chair 5 or a receiving aperture under an alternative type of chair 5. In other examples, a positive locking feature between the piston 30 and the base 10, and the mechanical device under the seat of the chair 5 will prevent the parts from misaligning. FIG. 7 shows a positive feature with the piston 30A having a key 50 and the base 10A having a recess 55 to receive the key 50. The positive feature can be in addition to the above-described taper.

One or more of the disclosed embodiments, alone or in combination, may provide one or more technical effects including a chair that increases an amount of leg room for a user. Accordingly, the disclosed designs may offer an improved office chair compared to other designs. The technical effects and technical problems in the specification are exemplary and are not limiting. It should be noted that the embodiments described in the specification may have other technical effects and can solve other technical problems.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that references to relative positions (e.g., "top" and "bottom," "left" and "right," "front" and "back") in this description are merely used to identify various elements as are oriented in the Figures. It should be recognized that the orientation of particular components may vary greatly depending on the application in which they are used.

For the purpose of this disclosure, the term "coupled" means the joining of two members directly or indirectly to one another. Such joining may be stationary in nature or movable in nature. Such joining may be achieved with the two members or the two members and any additional intermediate members being integrally formed as a single unitary body with one another or with the two members or the two members and any additional intermediate members being attached to one another. Such joining may be permanent in nature or may be removable or releasable in nature.

It is also important to note that the construction and arrangement of the system, methods, and devices as shown in the various examples of embodiments is illustrative only, and not limiting. Although only a few embodiments have been described in detail in this disclosure, those skilled in the art who review this disclosure will readily appreciate that many various alternatives, modifications, variations, improvements and/or substantial equivalents, whether known or that are or may be presently foreseen, are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements show as multiple parts may be integrally formed, the operation of the interfaces may be reversed or otherwise varied, the length or width of the structures and/or members or connector or other elements of the system may be varied, the nature or number of adjustment positions provided between the elements may be varied (e.g. by variations in the number of engagement slots or size of the engagement slots or type of engagement). The order or sequence of any process or method steps may be varied or re-sequenced according to alternative embodiments. Other substitutions, modifications, changes, and omissions may be made in the design, operating conditions, and arrangement of the various examples of embodiments without departing from the spirit or scope of the present inventions. Therefore, the invention is intended to embrace all known or earlier developed alternatives, modifications, variations, improvements and/or substantial equivalents.

What is claimed is:

1. A chair comprising:

a seat including a front and an opposing back, the front having opposing front corners and the back having opposing back corners;

a height-adjustable, rotationally-fixed central support coupled to the seat, the central support being rotationally fixed relative to the seat;

a first leg and a second leg coupled to and extending from the height-adjustable, rotationally-fixed central support, each of the first leg and the second leg extending toward the opposing front corners of the seat;

a third leg and a fourth leg coupled to and extending from the height-adjustable, rotationally-fixed central support, each of the third leg and the fourth leg extending toward the opposing back corners of the seat, wherein the first leg and the second leg define a first angle, the third leg and fourth leg define a second angle, and the first angle is greater than the second angle, and wherein the legs are rotationally fixed relative to the central support; and freely-rotating casters on ends of each of the legs.

2. The chair as defined in claim 1, wherein the first angle is equal to or greater than 90 degrees.

3. The chair as defined in claim 1, wherein the second angle is equal to or less than 90 degrees.

4. The chair as defined in claim 1, wherein the first leg and the second leg are each a first length and the third leg and the fourth leg are each a second length, wherein the first length is longer than the second length.

5. The chair as defined in claim 1, wherein the first and third leg define a third angle, the second and fourth leg define a fourth angle, and the third and fourth angle are equal.

6. The chair as defined in claim 5, wherein the first angle is larger than the third and fourth angles.

7. The chair as defined in claim 5, wherein the second angle is smaller than the third and fourth angles.

8. A seating device comprising:

a seat having a front;

a fixed non-rotating support coupled to the seat, the support being fixed relative to the front of the seat;

legs extending radially from the non-rotating support, the legs being rotationally fixed relative to the fixed non-rotating support, a pair of the legs defining an area under the front of the seat in which a user may position their feet, wherein an angle between the pair of the legs is at least 90 degrees; and a freely rotating caster on an end of each of the legs, respectively.

9. The seating device as defined in claim 8, wherein the pair of the legs is a first pair of legs, where the legs further include a second pair of legs extending from the fixed non-rotating support toward a back of the seating device, wherein a second angle between the second pair of legs is acute.

10. The seating device as defined in claim 9, wherein the first pair of legs has a first length and the second pair of legs has a second length, wherein the first length is longer than the second length.

11. A seating device comprising:

a fixed non-rotating support;

legs extending radially from the non-rotating support, pair of the legs defining an area under a front of the seating device in which a user may position their feet, wherein an angle between the pair of the legs is at least 90 degrees; and wherein the pair of the legs is a first group of legs, wherein the legs further include a second group of legs extending from the fixed non-rotating support toward a back of the seating device, wherein the second group of legs comprises at least three legs.

12. The seating device as defined in claim 11, wherein an angle formed between a leg and an adjacent leg of the second group of legs is acute.

13. The seating device as defined in claim 11, wherein the first group of legs has a first length and the second group of legs has a second length, wherein the first length is longer than the second length.

14. The seating device as defined in claim 11, wherein the legs are rotationally fixed relative to the non-rotating support.

15. The seating device as defined in claim 11, further comprising casters coupled to ends of each of the legs.

16. The seating device as defined in claim 11, further comprising a seat, wherein the legs are rotationally fixed relative to the seat.

17. The chair as defined in claim 1, wherein the first leg and the second leg define an area under the front of the seat in which a user may position their feet.

18. The chair as defined in claim 1, wherein the first leg and the second leg extend past an edge near the front corners of the seat.

19. The chair as defined in claim 1, wherein the third leg and the fourth leg extend past an edge near the back corners of the seat.

20. The chair as defined in claim 1, wherein the first leg and the second leg are each a first length and the third leg and the fourth leg are each a second length, wherein the first length is shorter than the second length.

21. The chair as defined in claim 1, wherein the height-adjustable, rotationally-fixed central support includes a height-adjustable, non-rotational piston.

22. The chair as defined in claim 21, further comprising a connection piece having an aperture that receives the height-adjustable, non-rotational piston and is formed with the legs.

* * * * *